US008653015B2

(12) United States Patent
Keller et al.

(10) Patent No.: US 8,653,015 B2
(45) Date of Patent: Feb. 18, 2014

(54) ENVIRONMENTALLY FRIENDLY, MULTI-PURPOSE REFLUXING CLEANER

(75) Inventors: Shahin Shahin Keller, Lexington Park, MD (US); Nancy E. Kaiser, Pontoon Beach, IL (US)

(73) Assignee: American Sterilizer Company, Mentor, OH (US)

( * ) Notice: Subject to any disclaimer, the term of this patent is extended or adjusted under 35 U.S.C. 154(b) by 0 days.

(21) Appl. No.: 13/066,362

(22) Filed: Apr. 13, 2011

(65) Prior Publication Data

US 2012/0264673 A1 Oct. 18, 2012

(51) Int. Cl.
*C11D 3/60* (2006.01)

(52) U.S. Cl.
USPC ..... 510/407; 510/405; 510/432; 510/434; 510/436

(58) Field of Classification Search
USPC ..... 510/407, 405, 432, 434, 436
See application file for complete search history.

(56) References Cited

U.S. PATENT DOCUMENTS

| | | | | | |
|---|---|---|---|---|---|
| 3,549,420 | A | * | 12/1970 | Cunningham | 134/22.19 |
| 5,232,515 | A | | 8/1993 | Sullivan | |
| 5,259,993 | A | | 11/1993 | Short | |
| 5,423,919 | A | * | 6/1995 | Dieter et al. | 134/8 |
| 5,454,972 | A | * | 10/1995 | Williams et al. | 510/177 |
| 5,516,450 | A | * | 5/1996 | Williams et al. | 510/177 |
| 5,628,833 | A | * | 5/1997 | McCormack et al. | 134/26 |
| 5,679,175 | A | | 10/1997 | Hayes et al. | |
| 5,698,045 | A | * | 12/1997 | Walsh et al. | 134/12 |
| 5,716,457 | A | * | 2/1998 | Hayes et al. | 134/26 |
| 5,866,523 | A | | 2/1999 | Turunc et al. | |
| 6,051,542 | A | * | 4/2000 | Pollack et al. | 510/426 |
| 6,187,719 | B1 | | 2/2001 | Dino et al. | |
| 6,202,654 | B1 | | 3/2001 | Karlsson et al. | |
| 6,268,324 | B1 | * | 7/2001 | Besse et al. | 510/197 |
| 6,644,326 | B2 | | 11/2003 | Dorton et al. | |
| 7,144,846 | B2 | * | 12/2006 | Keller et al. | 510/161 |
| 2005/0032913 | A1 | * | 2/2005 | McDonnell et al. | 514/731 |
| 2005/0256018 | A1 | * | 11/2005 | Keller et al. | 510/383 |
| 2009/0143273 | A1 | * | 6/2009 | Cheung | 510/391 |
| 2010/0234263 | A1 | * | 9/2010 | Wasan et al. | 510/218 |
| 2011/0146725 | A1 | * | 6/2011 | Woo et al. | 134/26 |

FOREIGN PATENT DOCUMENTS

| | | | |
|---|---|---|---|
| GB | 1 495 249 | | 12/1977 |
| JP | 2004-361433 | * | 12/2004 |

* cited by examiner

*Primary Examiner* — Mark Eashoo
*Assistant Examiner* — M. Reza Asdjodi
(74) *Attorney, Agent, or Firm* — Hudak, Shunk & Farine Co., LPA

(57) ABSTRACT

A solvent blend cleaner useful for reflux cleaning of chemical manufacturing equipment, including that used in manufacturing pharmaceuticals, comprises a blend of environmentally friendly and safe solvents selected on the basis of specific criteria, such as vapor pressure, vapor density, boiling point, specific heat, and heat of vaporization, among other things; achieves excellent cleaning even upon further dilution with water; and avoids the disadvantages associated with the use of conventional commodity solvents in reflux cleaning methods. Desired solvency, cleaning and wetting properties of the inventive formulations in use can be achieved through blending of solvents having the selected criteria. Additives, such as surfactants, can be added to enhance cleaning and lower solvent requirements.

9 Claims, No Drawings

ENVIRONMENTALLY FRIENDLY, MULTI-PURPOSE REFLUXING CLEANER

FIELD OF THE INVENTION

This invention is directed to a solvent-based cleaner useful for cleaning equipment associated with chemical manufacturing, including pharmaceuticals. More specifically, this invention is directed to a solvent-based cleaner that is environmentally friendly, in that it is safe to store, handle and use, and that can be used in a number of cleaning methods, such as a refluxing solvent, and in clean-in-place (CIP), clean-out-of-place (COP) and manual cleaning. Most particularly, this invention provides an efficient, effective refluxing solvent without the disadvantages of traditional refluxing chemicals.

BACKGROUND OF THE INVENTION

Chemical manufacturing (including Active Pharmaceutical Ingredients-API) generally involves several pieces of equipment in a train, such as a reactor, centrifuge, vessels, tanks, separating columns, crystallizers and associated tubes and piping. After manufacturing, the equipment must be cleaned prior to use in producing subsequent products. Cleaning the equipment train is typically performed by refluxing a solvent throughout the equipment, and its connecting pipes, rather than using a clean-in-place (CIP) system which requires additional specialized equipment and procedures.

Generally, conventional reflux cleaning methods utilize commodity solvents, such as methanol or acetone, which are placed in a reaction vessel or tank and then heated. These solvents are typically part of the production process, and therefore, are readily available and not a new ingredient being introduced as a potential contaminant. The vapors created by the heated solvent replace the air above the tank and travel through the piping to the next piece of equipment. In the overhead spaces, condensers are present to cool the vapor to a liquid. Liquid solvent is then drained out into a sump removing the soil or residue away from the equipment and piping. Since there is no mechanical action involved in reflux cleaning, cleaning may have to be repeated several times before the equipment is ready for the next processing batch.

The aforementioned refluxing commodity solvents and cleaning methods are not without disadvantages. Conventional reflux solvent cleaning process(es) requires that the equipment remain in place without the use of spray balls and additional equipment for agitation or recirculation, which is typical of CIP systems. Thus, there are no assurances that cleaning has been thorough and complete. More repetitions are required to assure complete soil removal. There are also significant energy costs associated with the recycling and recovery of solvents, as well as incineration and disposal costs. Safety issues also arise due to flammability and volatility associated with commodity solvents.

There is a need, therefore, for a product formulation that can be used in a reflux cleaning process as a replacement for harmful commodity solvents, without their attendant disadvantages. It has been found that aqueous blends of certain solvents may be combined to achieve a formulation having solvency, cleaning and wetting properties that enhance the ability to clean soil from chemical manufacturing equipment, including pharmaceuticals, effectively, in place of harmful commodity solvents. Such a formulation also performs well in both a vapor and liquid phase. These solvent blends may also contain other ingredients, such as surfactants, to enhance cleaning and lower solvent levels. For storage reasons, these solvent blends or solvent/surfactant blends may be prepared as a non-aqueous concentrate or as semi-aqueous liquid(s), all of which may be diluted further with water prior to use.

Solvent selection for the inventive formulations is based upon certain criteria including, but not limited to, properties such as high vapor pressure, high vapor density, moderate boiling points, low specified heat, and low heat of vaporization, as well as health and safety and environmental requirements. Solvent properties such as solvency and surfactancy are also desirable in a formulated blend. Selecting solvents on the basis of these criteria result in a formulation having superior solvency, cleaning, and wetting properties, over traditional commodity reflux solvents, which positively affect the time, energy and effectiveness of a reflux cleaning process.

Solvent-based cleaners for manufacturing equipment are known in the art. For example, U.S. Pat. No. 5,866,523 is directed to methods and solvent-blend compositions for removing resinous material from vessels, vats, drums, tanks, piping and relating equipment, which must be cleaned-in-place (C-I-P). Methods of use include, inter alia, agitation, spraying, vibrating, stirring, pump circulation, or physical contact. The disclosed formulations are used at 20-22° C. up to 70° C. (not boiling). The compositions contain methyl isoamyl ketone, which is quite flammable and not viable for use in a refluxing system.

U.S. Pat. No. 5,698,045 is directed to a vapor method for cleaning chemical process equipment, without dismantling, by placing a liquid containing N-methyl-pyrrolidone (NMP) in the equipment (reactor) and heating the NMP to boiling. The primary soils to be cleaned are polymer residues, such as styrene-containing polymers, PVC's, urethanes, epoxies, polyacrylics, nylons and carbon build-up and tarry films from degrading organic materials. The NMP can be used alone (i.e., "pure"), or may be blended with another solvent, gamma butyrolactone, or with oils or solvents having a higher boiling point than NMP. The composition is not aqueous.

U.S. Pat. Nos. 5,423,919 and 5,259,993 both disclose immersion cleaning compositions, containing solvents that include as one component, a 2-pyrrolidone, a known paint stripping agent, in amounts of 1-15 wt. % and 1-20 wt. %, respectively. While these two patents have the pyrrolidone component in common, the '919 patent also requires a ceramic particulate in the solvent. The '993 patent is focused upon a single solvent composition, not a solvent blend, which may be used at temperatures of 120° F.-140° F. and requires substrate immersion for cleaning to take place.

N-methyl-2-pyrrolidone (NMP) is also a component of the cleaning composition disclosed in U.S. Pat. No. 5,232,515, which is directed to a "water-reducible" composition. In addition to NMP, glycol ether esters and $C_1$-$C_8$ alcohols are included. Surfactants, rust inhibitors, and accelerators are optional components. There is no mention of the use of this composition in boiling or reflux cleaning operations.

U.S. Pat. Nos. 6,187,719; 5,679,175 and 5,716,457 are directed to non-aqueous "boiling" compositions, but not to reflux cleaning. The disclosed compositions comprise both solvating agents and rinsing agents. Neither are used in a reflux type operation. Solvating agents selected must have a room temperature vapor pressure of no greater than about 40 mm Hg and a solvating strength of no less than 10. Solvating agents may include 2-pyrrolidones, ethers, alcohols and mixtures thereof. Rinsing agents must have a room temperature vapor pressure of about 80-760 mm Hg and ozone depleting factors of no greater than about 0.05-0.15. The rinsing and solvating agents are not mixed together, but rather used separately. Indeed, they are required to be immiscible with each other. These solvating and rinsing compositions are stated to be useful for cleaning printed circuit boards (PCB's). The process steps involve immersing the board into a first boiling composition, i.e., the solvating agent; transferring the board through a vapor space above the boiling solvating agent into a container of cool liquid rinsing agent; transferring the board through a vapor space above the rinsing agent; and drying.

The aqueous inventive formulations described herein are unique over what has been previously known in the art and can be used as a replacement for commodity solvents in the reflux cleaning of chemical manufacturing equipment, especially that used in manufacturing pharmaceuticals. The manufacturer's existing cleaning process can remain unchanged with regard to equipment layout. While the inventive formulations are multi-purpose in that they can be used in various cleaning methods, such as CIP, COP and manual cleaning, the true advantage is that additional specialized cleaning equipment or procedures (such as for example with CIP processes) are not needed, as the inventive compositions are simply refluxed through the existing equipment line.

The inventive formulations perform effectively in both vapor phase and liquid phase and in both vertical and horizontal movement through the equipment train. The inventive formulations result in faster cleaning times and fewer repetitions of the cycles in a reflux cleaning process as encountered with conventional commodity refluxing solvents. They are also safer to handle and more environmentally friendly than conventional commodity refluxing solvents.

Energy requirements are also reduced with respect to recycling, recovery, disposal and incineration of solvents. Because the selected components are biodegradable and comply with global environmental regulations, disposal costs may be entirely eliminated or, at minimum, substantially reduced. Finally, the inventive formulations are safe to handle and non-flammable, thus eliminating the health and safety issues associated with conventional commodity solvents used for reflux cleaning.

Useful applications for the inventive formulations include reflux cleaning of chemical and pharmaceutical manufacturing equipment and research equipment, as well as any other cleaning applications where the formulation is effective for the particular soil/residue to be removed.

It is, therefore, an object of the invention to formulate a cleaning product, which can be used as a replacement for commodity solvents conventionally used to reflux-clean soils and residues left behind in a chemical or pharmaceutical manufacturing process.

A further object of the present invention is to provide a cleaning product which is multi-purpose, in that it can also be used in CIP, COP or manual cleaning processes, unlike traditional commodity refluxing solvents that cannot be so used and require that the equipment train remain unchanged.

Still a further object of the present invention is to reduce energy costs associated with traditional reflux cleaning processes and the number of required repetitions in the process.

Yet a further object of the present invention is to reduce health and safety issues associated with currently used commodity solvents and to provide a biodegradable product meeting applicable global environmental regulation standards and health and safety requirements.

SUMMARY OF THE INVENTION

The inventive formulations are effective and efficient refluxing cleaning compositions, which clean faster, i.e., require fewer cleaning cycles, than conventional refluxing solvents, such as methanol and acetone. The inventive formulations are also environmentally friendly, safer to use, handle and store, and cost less to dispose or recycle.

The inventive cleaning compositions are particularly useful in reflux cleaning of chemical manufacturing equipment trains, and may be used in CIP and COP operations, as well as in manual cleaning. However, the true advantage is due to their ability to be used as refluxing solvents, where no additional equipment is needed for cleaning (such as is required for CIP or COP systems).

The inventive compositions are useful in the cleaning of chemical manufacturing equipment. As used herein, "chemical manufacturing" includes not only basic chemicals, but also pharmaceuticals, personal products, natural and herbal products, food and food additives.

The inventive formulations may embody a semi-aqueous liquid comprising only blended solvents; a semi-aqueous liquid comprising blended solvents and surfactants; or a non-aqueous concentrated blend of solvents and surfactants. All embodiments may be further diluted with water prior to use. Other additives, such as hydrotropes, buffers, builders, corrosion inhibitors, anti-redeposition agents, rinsability agents, and the like may also be included as optional components of the inventive formulations.

Generally, the inventive refluxing cleaning compositions comprise: (a) a blend of at least two solvents; (b) optionally, surfactants; and (c) optionally, water, wherein the solvents are selected based upon the following criteria: vapor pressure, vapor density, boiling point, specific heat and heat of vaporization. Other criteria may also be considered. The selected components must also be environmentally friendly.

DETAILED DESCRIPTION OF THE INVENTION

This invention is directed to a cleaning formulation useful as a substitute for conventional commodity solvents used in reflux cleaning operations, such as methanol and acetone, with features that make the cleaning process faster, safer, cost effective and environmentally friendly. The inventive formulations may comprise: a semi-aqueous liquid formulation comprising only blended solvents; a semi-aqueous liquid formulation comprising blended solvents and other additives and surfactants to enhance cleaning and lower solvent levels; or a non-aqueous concentrated blend of solvents and surfactants. In all cases, the inventive formulations may be diluted or further diluted with water prior to use.

Generally, the inventive formulations must have better solvency, cleaning and wetting properties, when compared to commodity solvents. Key to preparing an efficacious formulation having the desired properties is the selection of solvents. Solvent selection criteria (properties) considered important to the resulting cleaning and wetting properties of the final inventive formulations include properties, such as high vapor pressure, high vapor density, moderate boiling point (100-150° C.), low specific heat and lower heat of vaporization. Other criteria such as low viscosity (as compared to water) and low surface tension (also less than water) may be considered. Boiling point, vapor pressure and vapor density are important criteria in selection. Notwithstanding these criteria, the overall chemistries of the solvents (i.e., solvency and surfactancy) and safety and environmental issues take precedence over a single property or properties of solvents. In any event, none of the individual properties of the solvents remain the same after a mixture is formulated.

Through selection of solvents having the specified properties, a final use formulation having desirable properties may be achieved. By way of general explanation, the final use formulation vapor pressure is preferably high and dense. High vapor pressure acts to fill open spaces faster, thus reducing air replacement time. Dense vapor reduces vapor loss to the surroundings and improves cleaning. Dense vapor also facilitates particulate removal.

Formulation components preferably have moderate boiling points (100-150° C.) and contribute to a final use formulation having a moderate boiling point. Warmer vapor improves cleaning efficacy. Yet, high boiling points (>150° C.) should be avoided, since higher boiling points increase energy costs and cause substrate compatibility issues.

Solvents with low specific heat reach their boiling point with less energy expended, thus decreasing energy consumption. Solvents with a lower heat of vaporization also require less energy to form a vapor. Blends of solvents having these properties result in a final use formulation that requires less energy to form a vapor or to reach its boiling point, thus conserving energy costs.

Further, solvents with lower viscosity than water move easier around crevices and bends in the equipment train, thus facilitating removal of particulates. Solvents with low surface tension (much less than water) clean similarly to surfactants. Hence, blending solvents with low surface tension and lower viscosity facilitates efficient cleaning in the final use formulation.

Solvents selected should meet health and safety requirements for handling, exposure and use, such as low flammability, low toxicity, low reactivity, substrate compatibility and biodegradability.

Finally, as stated above, the chemistries of the solvents and their compatability in a blend and with water are also important.

It is difficult to find a single solvent that meets all of the recommended selection criteria. Solvents are not required to meet all criteria; rather, solvents having varying properties can be used complementary to each other and to other components, such as surfactants. A solvent may be used to modify or adjust the properties of another solvent in the blend. The goal in solvent selection is to attain a final use reflux formulation that has better solvency, cleaning and wetting properties than traditional commodity solvents. That goal is accomplished by selecting solvents with certain properties, which, when combined, will result in the final formulation achieving the desired cleaning and wetting properties. Certain individual solvent selection properties are not measurable in the final blend, since they depend upon cleaning conditions, temperature, and concentration (dilution).

Solvents useful in the present inventive formulations are listed in Table 1, along with some of their properties. Commodity solvents, such as methanol, NPA and acetone are also included for comparison, along with water.

Preferably, two or more solvents should be blended to achieve a wider range of criteria in the final formulation. By way of example, evaporation rate is a measure of how fast vapor leaves a surface as compared to air. Vapors of a volatile solvent (i.e., low boiling point) evaporate from a surface too quickly and do not allow sufficient contact time for cleaning. This property can be optimized, however, by blending solvents with varying boiling points to achieve a formulation having acceptable evaporation rates.

In one embodiment, surfactants, chelants and other components may be added to enhance cleaning and reduce the amount of solvent needed. These additional components are selected based on their low foaming and easy rinsing characteristics (surfactants), as well as biodegradability and compliance with environmental and safety regulations.

The inventive formulations can be used for both vapor phase (such as refluxing type) and liquid phase cleaning. Vapor cleaning occurs due to vertical movement of cleaning vapors, while liquid cleaning occurs due to horizontal movement of cleaning liquid. In chemical manufacturing, including pharmaceuticals, both types of cleaning (i.e. vertical and horizontal) can be utilized for cleaning various equipment.

In the cleaning process, the diluted cleaning composition is placed in a reaction vessel or tank. As the diluted cleaning composition is heated, non-volatile ingredients remain in liquid phase and help to clean the reaction vessel, where the majority of the residue is left. Various combinations of non-volatile ingredients (surfactants, chelants and other components) can perform and enhance liquid phase cleaning. As a result, less solvent will be consumed for cleaning the residue in the reaction vessel, and clean, vaporized solvent is free to travel outward to pipes, tubes, vessels, tanks and equipment beyond the reaction tank. Condensers then cool the vapor to form a liquid, which will come in contact with other surfaces to be cleaned. The condensed vapor flows back to the reaction vessel where it can be discharged safely.

In preparing inventive formulations having superior solvency, cleaning and wetting properties over that of commodity solvents, several solvent selection criteria were considered, as discussed above. Table 1 shows characteristics (properties) for the solvents selected for use in the inventive formulations, as well as comparative properties for water, methanol, NPA and acetone.

TABLE 1

SOLVENTS CHARACTERISTICS

| Trade Name | Boiling Point (C.*) | Flash Point (F.*) | Evaporation Rate (Acet = 1) | Vapor Pressure (mmHg) @ 25° C. | Surface Tension (dynes/CM) | Chemical Name | Specific Gravity g/cc | Viscosity (cps) | Heat of Vaporization j/g @ BP | Vapor Density Air = 1 | Specific Heat j/g/° C. @ 25° C. | Cost $/lb |
|---|---|---|---|---|---|---|---|---|---|---|---|---|
| Dowanol DPM | 190 | 167 | 0.035 | 0.28 | 28.8 | Dipropylene Glycol Methyl Ether | 0.951 | 3.7 | 267 | 5.59 | 2.25 | 1.1 |
| Proglyde DMM | 175 | 149 | 0.13 | 0.82 | 26.3 | Dipropylene Glycol Dimethyl Ether | 0.902 | 1.1 | 257 | 5.59 | 01.83 | 1.44 |
| Purasolv EL | 153 | 139 | 0.26 | 1.6 | 30.6 | Ethyl Lactate | 1.033 | 2.8 | | 4.07 | | 1.94 |
| M Pyrol | 202* | 204* | 0.26 | 3.8 | 40.7 | 1-Methyl-2-Pyrrolidone | 1.027 | 1.65 | 369 | | 0.3 | 2.63 |
| Dowanol PnP | 149 | 118 | 0.21 | 1.5 | 25.4 | Propylene Glycol n-Propyl Ether | 0.883 | 4.4 | 369 | 5.27 | 1.98 | 1.38 |

TABLE 1-continued

SOLVENTS CHARACTERISTICS

| Trade Name | Boiling Point (C.*) | Flash Point (F.*) | Evaporation Rate (Acet = 1) | Vapor Pressure (mmHg) @ 25° C. | Surface Tension (dynes/CM) | Chemical Name | Specific Gravity g/cc | Viscosity (cps) | Heat of Vaporization j/g @ BP | Vapor Density Air = 1 | Specific Heat j/g/° C. @ 25° C. | Cost $/lb |
|---|---|---|---|---|---|---|---|---|---|---|---|---|
| Dowanol PPh | 242.7 | 240 | 0.01 | 0.01 | 38 | Propylene Glycol Phenol Ether | 1.063 | 2.45 | 319 | 5.27 | 2.18 | 1.47 |
| Dowanol EB | 171 | 150 | 0.07 | 0.88 | 27.4 | Ethylene Glycol n-Butyl Ether | 0.897 | 3.15 | | 4.1 | | 1.1 |
| Rhodasolve IRIS | 218 | 208 | 0.06 | 6.5 | 33 mN/m | Dimethyl methyl glutarate-dibasic ester | 1.05 | | | | | |
| Dowanol DB | 230 | 310 | 0.03 | 0.06 | 30 | Diethylene Glycol n-Butyl Ether (slow evaporating/hydrophilic) | 0.951 | 4.9 | 276 | 2 | 2.26 | 1.25 |
| Methanol | 65 | 52 | 6.1 | 2.1 | 22.6 | Methyl Alcohol | 0.79 | 0.59 | 263 | 1.11 | 2.51 | 0.75 |
| NPA | 97.2 | 73 | 1.3 | 2.8 | 23.75 | Normal Propyl Alcohol | 0.805 | 2.2 | 188 | 2.1 | 0.53 | 1.1 |
| Water | 100 | | 0.30 | 23.8 | 73 | Oxidane | 1.00 | 1.02 | 2.2 kj/g | 1.0 | 4.18 | 0 |
| Acetone | 55 | −1.8 | 5.6 | 0.24 | 23 | Dimethyl Ketone | 0.792 | 3.6 | 0.501 kj/g | 2.0 | 2.18 | 1.2 |

As discussed, a blend of solvents is used, having desired selection criteria, to optimize the final properties of the inventive compositions. Solvents are selected in such a way that their properties, individually or as blended, are close to the characteristics desired for the final use dilution of the inventive formulation. Based on the solvents selected, the final formulation properties may be easily predicted. However, it may not be possible to measure all of the properties of the final formulation, since they will vary and depend upon cleaning conditions, temperature, and concentration (dilution). Since the final formulation may be diluted down to 5-10% with water, the final properties will also depend on the amount of any water used for dilution.

The boiling point of a liquid is the temperature at which the vapor pressure of the liquid is equal to the atmospheric pressure. Boiling points of selected solvents are in the range of about 100° C. to about 300° C., preferably about 120° C. to about 250° C., and most preferably about 150° C. to about 220° C.

Boiling points of the final blended formulation in its "use dilution" are in the range of about 90° C. to about 120° C., preferably about 95° C. to about 110° C., and most preferably from about 98° C. to about 102° C., which may be achieved through blending solvents with various boiling points.

Flash points (° F.) of selected solvents should be in the range of 140° F. to 300° F., preferably 150° F. to 250° F., and most preferably 180° F. to 220° F. Again, blends of solvents can be used to assure that the flash point is within a preferred range for the final use dilution of the formulation.

Evaporation rates have an inverse relationship to the boiling point, i.e., the higher the boiling point, the lower the rate of evaporation. Solvents with a high evaporation rate readily form a vapor. An evaporation rate of >3 (BuAc=1) is considered fast, 0.8 to 3.0 is medium, and <0.8 is considered slow (water=0.3). The selected solvents have an evaporation rate in the range of 0.04 to 1.0, preferably 0.1 to 0.8, and most preferably 0.2 to 0.5.

Vapor pressure (mmHg@25° C.) is the tendency of a liquid to form vapor. Vapor pressure increases non-linearly with temperature. Vapor pressure (mmHg@25° C.) of selected solvents should be in the range of 0.5 to 4.0 mmHg (25° C.), preferably in the range of 0.8 to 3.8 mmHg (25° C.), and most preferably in the range of 0.9 to 3.5 mmHg (25° C.).

Heat of vaporization (j/g@BP) is the heat absorbed by a gram of liquid at its boiling point to form vapor. Solvents with a low heat of vaporization require less energy to produce vapor. Heat of vaporization (j/g@BP) of selected solvents should be in the range of 100 to 380 (j/g@BP), preferably 150 to 350 (j/g@BP), and most preferably 250 to 320 (j/g@BP).

Vapor density is the molar weight of vapor compared to air (air=1). Vapor density reduces the loss of vapor to the surrounding air and thus improves the cleaning efficiency of the vapor. Vapor density of the selected solvents is in the range of 3.0 to 9.0, preferably 4.0 to 8.0, and most preferably 5.0 to 6.0.

Specific heat is the energy required to raise the temperature of a liquid by one degree. Specific heat is related to the inherent chemistry and bond structure of a solvent. Specific heat (j/g/° C.) at 25° C. of selected solvents is in the range of 0.1 to 2.5, preferably in the range of 0.15 to 1.8, and most preferably in the range of 0.16 to 1.5.

It is important to note that some of the solvent selection criteria values can change with temperature and pressure. These changes are not always linear. Thus, the criteria in Table 1 should be viewed as a general guide for solvent selection.

Cost is a factor in selection, but is not a driving criteria since the inventive formulations achieve cleaning faster and require less product to perform effectively.

Other criteria may also be considered. Surface tension allows the soil to dissolve in the solvent blend. These values should be much less than water for cleaning optimization. Surface tension (dynes/cm) of selected solvents ranges between about 15 to about 40 (dynes/cm). Specific gravity (g/cc) of selected solvents is typically in the range of about 0.9 to about 1.0 (g/cc). Solvents with low viscosity are preferred, since they will not resist flow and will move around bends in the equipment faster for efficient cleaning. Viscosity (cps) ranges preferred are from about 1.0 to about 3.5 (cps).

All of the foregoing criteria are useful in selecting appropriate solvents for the refluxing composition. Blends of solvents of various categories (polar protic or polar aprotic) and chemistries may be utilized, and indeed are preferred, in order to come up with a balanced formulation having properties that will be effective and efficient for reflux cleaning. Of the above criteria, boiling point and vapor density are the most important in selecting solvents to formulate into a blended solvent refluxing composition. Also important are environmental considerations and safety factors.

As is evident, a large number of potential selection criteria combinations can be made, based upon Table 1. The key to the inventive formulations, however, is that the final formulations, in total, have better solvency and wetting properties than commodity solvents. Key "end use" properties are boiling point and vapor pressure, which are also important solvent selection criteria. The end use properties depend on the solvent selection criteria and may be predicted by the dilution. Selected solvents should also have a moderate boiling point (100-150° C.), although any individual solvent's boiling point can be modified through blending.

The desired outcomes for the inventive compositions are environmental benefits, such as complying with VOC regulations and ground discharge and addressing safety concerns such as storage, handling and transportation. Secondary objectives are cleaning efficiency and versatility, which are achieved primarily because of the differences between the commodity solvents (methanol and acetone) and the inventive formulations. The inventive formulations have properties that provide enhanced reflux cleaning through the blending of a variety of solvents having the recommended criteria.

Improved cleaning performance is achieved because the recommended solvents can be heated safely (high flash point) to a higher temperature than the commodity solvents. Higher boiling points create higher vapor pressure and lower evaporation rate. Energy requirements are reduced by selecting solvents with low specific heat, low heat of vaporization and high vapor density. Blending solvents with various chemistries, such as by chemical classes of compounds or by types of polarity, can also enhance the cleaning process.

Surfactants and hydrotropes may also be used in the inventive formulations to enhance cleaning and to reduce the amount of solvent required, thus reducing costs. Useful surfactants include anionic, nonionic and amphoteric surfactants and are well known to one skilled in the art. Specifically, useful surfactants include alcohol ethoxylates, EO/PO block copolymers, sulfonates, phosphate esters, alkanoates, amine oxides, alkyl polyglucosides, octyl dipropionates, and mixtures thereof. Criteria used to select surfactants for use in the inventive formulations include compatibility with the solvents, stability, low to moderate foaming, good rinsability, ability to withstand boiling temperatures of the blend, biodegradability (EU648) and compliance with Reach regulations. Surfactants may be present in the inventive formulation in amounts ranging from about 0 to about 20 wt. %, based on the total weight of the final formulation.

The inventive formulations may also include chelants or sequestrants, such as sodium methyl glycine diacetic acid (MGDA), aspartic acid, sodium gluconate, and ethylene diamine disuccinate (EDDS); acid and base buffers, such as ethyl lactate, sodium acetate, sodium hydroxide, or potassium hydroxide; corrosion inhibitors, such as borate and phosphate esters; builders; and anti-redeposition and rinsability agents, such as acrylic acid polymers or co-polymers.

The inventive formulations are prepared as semi-aqueous solvent blends; semi-aqueous solvent and surfactant blends; or non-aqueous solvent blend concentrates. In all instances, the inventive formulations are further diluted with water. Water content of the final in-use reflux cleaning composition ranges from about 0 to about 80% although water content may range to about 90%.

The inventive formulations can be used in a wide variety of cleaning applications and methods. Table 2 illustrates the types of soils contemplated, which were previously cleaned with other solvents, but is by no means exhaustive of the applications or soils for which the inventive formulations are effective.

TABLE 2

API Soils and Cleaning Chemistries

| API Soils | Cleaning Chemistries Used |
|---|---|
| PM26803-00 C50 Magenta | Hot Xylene |
| PM26801-00 Xerox Custom Red #2 | Methanolic KOH |
| UK-182973 Oxime | Methanol |
| Venlafaxine | Methanol, Acetone |
| NCMC-NCA | 3% Caustic or 2-3% HCl |
| Tosylate | Water, methanol and 0.5% wt. Sulfuric Acid |
| Para Nitro Phenol Chloroformate | 35 Caustic or 2-3% HCl |
| Resolved Thiophene Amino Alcohol | Water and methanol |
| D-Cycloxylglycine | Methanol, 5% Caustic |
| Megestrol Acetate Mother Liquors | Acetone + Water |
| D,L-Lactide-Glycolide Copolymer | Steam, Organic Solvent |
| D,L-PLGA with Acid End Group | Steam, Organic Solvent |

EXAMPLES

Example 1

The following formulations, all of which are within the scope of the invention, were prepared. The trade names listed for specific components are exemplary only as many components are available from multiple manufacturers.

TABLE 3

Experimental Formula A (6486-25A)

| Ingredient | Type/Function | Trade Name | w/w % |
|---|---|---|---|
| Propylene Glycol n-Propyl Ether | Solvent | Dowanol PnP | 12.8 |
| Dipropylene Glycol Methyl Ether | Solvent | Dowanol DPM | 25.1 |
| Alcohol Ethoxylate | Nonionic | ECOSurf SA 9 | 7.2 |
| Na3 MGDA | Chelant | Trilon M | 5.7 |
| Lactic Acid | Acid | Lactic Acid | 1.4 |
| Soft Water | Water | Soft Water | 37.5 |
| 50% NaOH | Base | 50% NaOH | 0.4 |
| Surfactant Blend | Anionic Hydrotrope | Colatrop CA | 9.9 |

TABLE 4

Experimental Formula B (6486-38A)

| Ingredient | Type/Function | Trade Name | w/w % |
|---|---|---|---|
| Ethyl Lactate | Solvent | Purasolv EL | 7.3 |
| 1-Methyl-2-Pyrrolidone | Solvent | M Pyrol | 7.3 |
| Dipropylene Glycol Dimethyl Ether | Solvent | Proglyde DMM | 7.5 |
| Na3 MGDA | Chelant | Trilon M | 3.7 |
| Dipropylene Glycol Methyl Ether | Solvent | Dowanol DPM | 18.2 |
| Block Copolymer | Nonionic | Tergitol L62 | 1.1 |
| Alkyl Polyglucoside | Nonionic Hydrotrope | Berol 6206 | 3.5 |
| Amine Oxide | Complex Surfactant | Mackamine C8 | 4.5 |
| Soft Water | Solvent | Soft Water | 46.8 |

TABLE 5

Experimental Formula C (6486-39C)

| Ingredient | Type/Function | Trade Name | w/w % |
|---|---|---|---|
| Ethyl Lactate | Solvent | Purasolv EL | 12.58 |
| Dipropylene Glycol Dimethyl Ether | Solvent | Proglyde DMM | 13.71 |
| Na3 MGDA | Chelant | Trilon M | 4.46 |
| Aromatic Alcohol Ethoxylate | Nonionic | Ethylan HB4 | 4.97 |
| Amine Oxide | Complex Surfactant | Mackamine C8 | 6.87 |
| 1-Methyl-2-Pyrrolidone | Solvent | M Pyrol | 13.26 |
| Soft Water | Solvent | Soft Water | 44.15 |

TABLE 6

Experimental Formula D (6486-42E)

| Ingredient | Type/Function | Trade Name | w/w % |
|---|---|---|---|
| Ethyl Lactate | Solvent | Purasolv EL | 6.86 |
| 1-Methyl-2-Pyrrolidone | Solvent | M Pyrol | 6.86 |
| Dipropylene Glycol Dimethyl Ether | Solvent | Proglyde DMM | 7.16 |
| Na3 MGDA | Chelant | Trilon M | 3.51 |
| Dipropylene Glycol Methyl Ether | Solvent | Dowanol DPM | 17.26 |
| Block Copolymer | Nonionic | Tergitol L62 | 1.04 |
| Alkyl Polyglucoside | Nonionic | Berol 6206 | 3.0 |
| Amine Oxide | Complex Surfactant | Mackamine C8 | 4.27 |
| Soft Water | Solvent | Soft Water | 44.39 |
| Lactic Acid | Buffer Acid | Lactic Acid | 1.66 |
| 50% NaOH | Buffer Base | 50% NaOH | 3.89 |

TABLE 7

Experimental Formula E (6486-82A)

| Ingredient | Type/Function | Trade Name | w/w % |
|---|---|---|---|
| Soft Water | Solvent | Soft Water | 48.1 |
| Dipropylene Glycol Methyl Ether | Solvent | Dowanol DPM | 10.0 |
| Na3 MGDA | Chelant | Trilon M | 6.1 |
| Lactic Acid | Buffer Acid | Lactic Acid | 2.1 |
| 50% NaOH | Buffer Base | NaOH 50% | 3.4 |
| Phosphate Ester | Anionic | Deterge 7315 | 4.8 |
| Sodium Cumene Sulfonate | Anionic | SCS | 4.5 |
| Dipropylene Glycol Dimethyl Ether | Solvent | Proglyde DMM | 6.0 |
| Ethyl Lactate | Solvent | Purasolv EL | 7.5 |
| Block Copolymer | Nonionic | Tergitol L62 | 2.1 |
| Diethylene Glycol n-Butyl Ether | Solvent | Dowanol DB | 5.2 |

TABLE 8

Experimental Formula F (6359-12)

| Ingredient | Type/Function | Trade Name | w/w % |
|---|---|---|---|
| Soft Water | Solvent | Soft Water | 53.89 |
| Sodium Hydroxide (50%) | Alkalinity Source | Sodium Hydroxide (50%) | 1.75 |
| Sodium Gluconate (Liquid) | Buffer, Builder, Chelant | Glucon SGA 60 | 4.5 |
| Ethylene Diamine Disuccinate (EDDS) (Liquid) | Chelant | Natriquest E30 | 3.01 |
| Acrylic Copolymer | Anti-redeposition, Rinsibility | Polyquart Amph 149 | 1.98 |

TABLE 8-continued

Experimental Formula F (6359-12)

| Ingredient | Type/Function | Trade Name | w/w % |
|---|---|---|---|
| Borate Ester | Corrosion Inhibitor | DeCore BE 85 | 0.94 |
| Dipropylene Glycol Methyl Ether | Solvent | Dowanol DPM | 10.11 |
| Ethyl Lactate | Solvent | Purasolv EL | 9.17 |
| Dipropylene Glycol Dimethyl Ether | Solvent | Proglyde DMM | 9.54 |
| Octyl Dipropionate | Amphoteric Surfactant | Mackam ODP | 2.44 |
| Block Copolymer | Nonionic Surfactant | Tergitol L 62 | 2.65 |

TABLE 9

Experimental Formula G (6359-44A)

| Ingredient | Type/Function | Trade Name | w/w % |
|---|---|---|---|
| Dipropylene Glycol Methyl Ether | Solvent | Dowanol DPM | 47.95 |
| Ethyl Lactate | Solvent | Purasolv EL | 28.55 |
| 1-Methyl-2-Pyrrolidone | Solvent | M Pyrol | 23.50 |

TABLE 10

Experimental Formula H (6539-43)

| Ingredient | Type/Function | Trade Name | w/w % |
|---|---|---|---|
| Propylene Glycol n-Propyl Ether | Solvent | Dowanol PnP | 9.3 |
| Dipropylene Glycol Methyl Ether | Solvent | Dowanol DPM | 13.9 |
| Propylene Glycol Phenyl Ether | Solvent | Dowanol PPh | 13.9 |
| 1-Methyl-2-Pyrrolidone | Solvent | M Pyrol | 13.8 |
| Ethyl Lactate | Solvent | Purasolv EL | 13.8 |
| Ethylene Diamine Disuccinate (EDDS) (Liquid) | Chelant | Natriquest E30 | 4.7 |
| Soft Water | Solvent | Soft Water | 18.9 |
| Amine Oxide | Complex Surfactant | Mackamine C8 | 11.7 |

TABLE 11

Experimental Formula I (6486-78)

| Ingredient | Type/Function | Trade Name | w/w % |
|---|---|---|---|
| Ethyl Lactate | Solvent | Purasolv EL | 6.86 |
| 1-Methyl-2-Pyrrolidone | Solvent | M Pyrol | 6.96 |
| Dipropylene Glycol Dimethyl Ether | Solvent | Proglyde DMM | 7.16 |
| Na3 MGDA | Chelant | Trilon M | 3.51 |
| Dipropylene Glycol Methyl Ether | Solvent | Dowanol DPM | 17.26 |
| Block Copolymer | Nonionic | Tergitol L62 | 1.04 |
| Alkyl Polyglucoside | Nonionic | Berol 6206 | 3.0 |
| Amine Oxide | Complex Surfactant | Mackamine C8 | 4.27 |
| Soft Water | Solvent | Soft Water | 44.39 |
| Lactic Acid | Buffer Acid | Lactic Acid | 1.66 |
| 50% NaOH | Buffer Base | 50% NaOH | 3.89 |

TABLE 12

| Experimental Formula J (6486-82A) | | | |
|---|---|---|---|
| Ingredient | Type/Function | Trade Name | w/w % |
| Soft Water | Solvent | Soft Water | 48.1 |
| Dipropylene Glycol Methyl Ether | Solvent | Dowanol DPM | 10.0 |
| Na3 MGDA | Chelant | Trilon M | 6.1 |
| Ethyl Lactate | Buffer Acid | Lactic Acid | 2.1 |
| 50% NaOH | Buffer Base | NaOH 50% | 3.4 |
| Phosphate Ester | Anionic | Deterge 7315 | 4.8 |
| Sodium Cumene Sulfonate | Anionic | SCS | 4.5 |
| Dipropylene Glycol Dimethyl Ether | Solvent | Proglyde DMM | 6.0 |
| Ethyl Lactate | Solvent | Purasolv EL | 7.5 |
| Block Copolymer | Nonionic | Tergitol L62 | 2.1 |
| Diethylene Glycol n-Butyl Ether | Solvent | Dowanol DB | 5.2 |

TABLE 13

| Experimental Formula K (6539-44B) | | | |
|---|---|---|---|
| Ingredient | Type/Function | Trade Name | w/w % |
| Dipropylene Glycol Dimethyl Ether | Solvent | Dowanol DMM | 27.7 |
| Propylene Glycol Phenyl Ether | Solvent | Dowanol PPh | 12.68 |
| Potassium Alkanoate | Anionic Hydrotrope | Colatrop OD | 4.0 |
| Diethylene Glycol n-Butyl Ether | Solvent | Dowanol DB | 18.6 |
| Ethylene Diamine Disuccinate (EDDS) (Liquid) | Chelant | Natriquest E30 | 0.53 |
| Soft Water | Solvent | Soft Water | 38.51 |

TABLE 14

| Experimental Formula L (6539-68A) | | | |
|---|---|---|---|
| Ingredient | Type/Function | Trade Name | w/w % |
| Dipropylene Glycol Dimethyl Ether | Solvent | Dowanol DMM | 48.0 |
| 1-Methyl-2-Pyrrolidone | Solvent | M Pyrol | 18.0 |
| Ethyl Lactate | Solvent | Purasolv EL | 23.0 |
| Block Copolymer | Nonionic | Pluronic 25 R2 | 1.0 |

TABLE 15

| Experimental Formula M (6539-68D) | | | |
|---|---|---|---|
| Ingredient | Type/Function | Trade Name | w/w % |
| Dipropylene Glycol Dimethyl Ether | Solvent | Dowanol DMM | 4.0 |
| 1-Methyl-2-Pyrrolidone | Solvent | Purasolv EL | 2.4 |
| Ethyl Lactate | Solvent | M Pyrol | 2.0 |
| Block Copolymer | Nonionic | Pluronic 25 R2 | 0.05 |
| KOH 45% | Alkalinity | KOH 45% | 0.72 |
| Soft Water | Solvent | Soft Water | 90.8 |

TABLE 16

| Experimental Formula N (6539-67A) | | | |
|---|---|---|---|
| Ingredient | Type/Function | Trade Name | w/w % |
| Dipropylene Glycol Dimethyl Ether | Solvent | Dowanol DMM | 47.95 |
| Ethyl Lactate | Solvent | Purasolv EL | 28.53 |
| 1-Methyl-2-Pyrrolidone | Solvent | M-Pyrol | 23.52 |

TABLE 17

| Experimental Formula O (6539-68) | | | |
|---|---|---|---|
| Ingredient | Type/Function | Trade Name | w/w % |
| Dipropylene Glycol Dimethyl Ether | Solvent | Dowanol DMM | 4.05 |
| Ethyl Lactate | Solvent | Purasolv EL | 2.41 |
| 1-Methyl-2-Pyrrolidone | Solvent | M Pyrol | 1.99 |
| EO/PO/Copolymer | Emulsifier/Block Copolymer | Meroxapal 252 (Pluronic 25 R2) | 0.05 |
| Potassium Hydroxide (45%) | Alkalinity Agent | Potassium Hydroxide | 0.72 |
| Soft Water | Solvent | Soft Water | 90.78 |

Example 2

Cleaning Evaluations

Set-Up

A reflux apparatus was set up under a hood with sufficient water and electric power supply connections to simulate use of a refluxing cleaner in a manufacturing environment. Boiling flasks, each containing various inventive formulations were heated using a heating mantel. A soxhlet was placed above and attached to the flask. 2"×4" stainless steel coupons, with dried pharmaceutical soils, as identified in Table 16, were placed in the soxhlet(s) or suspended by a metal wire into the soxhlet(s). A condenser tube attached to cold running water condensed the vapors generated from the cleaning formulations, and the condensed vapor collected in the soxhlet where the soiled coupon(s) had been were placed.

Soils

Due to the large number of potential soils, only a few of the inventive formulations were screened for cleaning performance. The control, methanol, was not used for all soils as a comparison. The assumption was that methanol performs satisfactorily and is capable of removing the majority of the soils completely, however, not without its attendant disadvantages.

In the cleaning procedure, a 5% w/w dilution of each of the inventive formulations was used. The activity of this dilution was not optimized for 100 percent cleaning or water break free (WBF). Reflux cleaning time was 20-30 minutes. Coupons were rinsed with ambient tap water for 60 seconds. The results of the cleaning, as a percentage of soil removed, are set forth in Table 16.

TABLE 18

| Percentage Soil Removed | | | | | | | | | |
|---|---|---|---|---|---|---|---|---|---|
| Soil Name | 6486-25A (A) | Control Methanol | 6486-78 (I) | 6486-82A (E) | 6539-12 (F) | 6539-44B (K) | 6539-67A (N) | 6539-68C (O) | 6539-44A (G) |
| St. John's Wart | 94 | 34 | 95.6 | 93.8 | 99.5 | | | 76.8 | |
| Acetophenone | | 14 | | | 87 | 36 | | | |
| Benserdiazide | | 96.8 | | | 100.0 | 96.2 | 97.0 | | 99.0 |
| Venlafaxine | 81.0 | 98 | | | | 97.0 | | | |
| Hexadecane | | 87.5 | | | | | 94.5 | 99.0 | |
| Triethylene Glycol di-p-Tosylate | | 100 | | | | 96.0 | 100.0 | | |
| Resorcinol Monobenzoate | | 99.2 | | | | | 100.0 | | |
| EM 1421 | | 98.1 | | | | 98.8 | 98.5 | | |
| Termomeprocal | | 98.0 | | | | 97.7 | 99.8 | | |
| First Aid Burn Gel | | | 87.0 | 96.5 | 98.4 | | | | |
| Antimicrobial Ointment | | | 97.8 | 87.3 | | | | | |
| Aspirin | | | 98.9 | 100 | | | | | |

The above evaluations indicated that a solvent cleaner, formulated in accordance with the invention, upon heating to a boiling point, created vapors of the volatile components (solvent and water). Since the major component in the diluted cleaning compositions was water, the boiling point of the cleaning dilution was close to the boiling point of water (100° C.). The results showed that the inventive formulations, in most cases, performed the same as or better than the commodity solvent, methanol.

Non-volatile components (surfactants, chelants, buffers) of the formulations, in practice, would be expected to contribute to liquid phase cleaning of a reaction vessel where the majority of residue is located. Non-volatile ingredients would not be expected to move to the other pieces of equipment. The non-volatile components can be safely discharged before the rinsing step; and, depending on the design of the plant, if the condensed vapors are routed back to the reaction vessel, all of the content can be discharged into a waste sump.

In accordance with the patent statutes, the best mode and preferred embodiment have been set forth; the scope of the invention is not limited thereto, but rather by the scope of the attached claims.

What is claimed is:

1. A concentrated, non-aqueous solvent blend for use as a substitute for traditional commodity cleaning solvents, such as methanol and acetone, in reflux cleaning of soiled chemical manufacturing equipment, consisting of:

a. at least three biodegradable solvents consisting of 1-methyl-2-pyrrolidone, normal propyl alcohol, dipropylene glycol methyl ether, dipropylene glycol dimethyl ether, ethyl lactate, propylene glycol n-propyl ether, propylene glycol phenyl ether, ethylene glycol n-butyl ether, diethylene glycol n-butyl ether, or mixtures thereof; wherein the selected solvents have a vapor pressure (mm Hg@25° C.) ranging from about 0.1 to about 7.0; a vapor density (air=1) ranging from 2.0 to about 6.0; a boiling point ranging from about 100° C. to about 300° C.; a specific heat (j/g/° C.) ranging from about 0.3 to about 2.3; a heat of vaporization (j/g@BP) ranging from about 250.0 to about 270.0; and a surface tension lower than that of water upon dilution with water the composition forms a low viscosity use solution.

2. A concentrated, non-aqueous solvent blend for use as a substitute for traditional commodity cleaning solvents, such as methanol and acetone, in reflux cleaning of soiled chemical manufacturing equipment, consisting of:

a. at least three biodegradable solvents consisting, of 1-methyl-2-pyrrolindone, normal propyl alcohol, dipropylene glycol methyl ether; dipropylene glycol dimethyl ether, ethyl lactate, propylene glycol n-propyl ether, propylene glycol phenyl ether, ethylene glycol n-butyl ether diethylene glycol n-butyl ether, or mixtures thereof; wherein the selected solvents have a vapor pressure (mm Hg@25° C.) ranging from about 0.1 to about 7.0; a vapor density (air=1) ranging from 2.0 to about 6.0; a boiling point ranging from about 100° C. to about 300° C.; a specific heat (j/g/° C.) ranging from about 0.3 to about 2.3; a heat of vaporization (j/g@BP) ranging from about 250.0 to about 270.0; and a surface tension lower than that of water upon dilution with water the composition forms a low viscosity use solution;

b. a surfactant that is an alcohol ethoxylate, an EO/PO block copolymer, a sulfonate, a phosphate ester, an alkanoate, an amine oxide, an alkyl polyglucoside, a dipropionate, or mixtures thereof;

c. a chelating agent; and d. a buffer.

3. The concentrated, non-aqueous solvent blend as set forth in claim 1 or 2, further diluted with water.

4. A concentrated, non-aqueous solvent blend for use as a substitute for traditional commodity cleaning solvents, such as methanol and acetone, in reflux cleaning of soiled chemical manufacturing equipment consisting of:

a. at least three biodegradable solvents consisting of 1-methyl-2-pyrrolidone, normal propyl alcohol, propylene glycol-n-propyl ether, dipropylene glycol methyl ether, dipropylene glycol methyl ether, ethyl lactate, propylene glycol phenyl ether, diethylene glycol n-butyl ether, or mixtures thereof; wherein the selected solvents have a vapor pressure ranging (mmHg@25° C.) from about 0.1 to about 7.0; a vapor density (air=1) ranging from 2.0 to about 6.0; a boiling point ranging from about 100° C. to about 300° C.; a specific heat (j/g/° C.) ranging from about 0.3 to about 2.3; a heat of vaporization (j/g@BP) ranging from about 250.0 to about 270.0; a surface tension lower than that of water;

b. a surfactant that is an alcohol ethoxylate, an EO/PO block copolymer, a sulfonate, a phosphate ester, an alkanoate, an amine oxide, an alkyl polyglucoside, a dipropionate, or mixtures thereof; and c. a chelant.

5. The concentrated, non-aqueous solvent blend as set forth in claim 4, further diluted with water.

6. A concentrated, non-aqueous solvent blend, for use as a substitute for traditional commodity cleaning solvents, such as methanol and acetone, in reflux cleaning of soiled chemical manufacturing equipment, consisting of:

a. at least three biodegradable solvents consisting of 1-methyl-2-pyrrolidone, normal propyl alcohol, propylene glycol-n-propyl ether, dipropylene glycol methyl ether, dipropylene glycol methyl ether, ethyl lactate, propylene glycol phenyl ether, diethylene glycol n-butyl ether, or mixtures thereof; wherein the selected solvents have a vapor pressure ranging (mmHg@25° C.) from about 0.1 to about 7.0; a vapor density (air=1) ranging from 2.0 to about 6.0; a boiling point ranging from about 100° C. to about 300° C.; a specific heat (j/g/° C.) ranging from about 0.3 to about 2.3; a heat of vaporization (j/g@BP) ranging from about 250.0 to about 270.0; a surface tension lower than that of water; and b. a surfactant that is an alcohol ethoxylate, an EO/PO block copolymer, a sulfonate, a phosphate ester, an alkanoate, an amine oxide, an alkyl polyglucoside, a dipropionate, or mixtures thereof.

7. A concentrated, non-aqueous solvent blend, for use as a substitute for traditional commodity cleaning solvents, such as methanol and acetone, in reflux cleaning of soiled chemical manufacturing equipment, consisting of:

a. at least three biodegradable solvents consisting of 1-methyl-2-pyrrolidone, normal propyl alcohol, propylene glycol-n-propyl ether, dipropylene glycol methyl ether, dipropylene glycol methyl ether, ethyl lactate, propylene glycol phenyl ether, diethylene glycol n-butyl ether, or mixtures thereof; wherein the selected solvents have a vapor pressure ranging (mmHg@25° C.) from about 0.1 to about 7.0; a vapor density (air=1) ranging from 2.0 to about 6.0; a boiling point ranging from about 100° C. to about 300° C.; a specific heat (j/g/° C.) ranging from about 0.3 to about 2.3; a heat of vaporization (j/g@BP) ranging from about 250.0 to about 270.0; a surface tension lower than that of water;

b. a surfactant that is an alcohol ethoxylate, an EO/PO block copolymer, a sulfonate, a phosphate ester, an alkanoate, an amine oxide, an alkyl polyglucoside, a dipropionate, or mixtures thereof; and c. a buffer.

8. The concentrated, non-aqueous solvent blend refluxing cleaning composition as set forth in claim 6 or 7 further diluted with water.

9. A semi-aqueous solvent blend for use as a substitute for traditional commodity cleaning solvents, such as methanol and acetone, in reflux cleaning of soiled chemical manufacturing equipment, consisting of:

a. at least three biodegradable solvents consisting of 1-methyl-2-pyrrolidone, normal propyl alcohol, dipropylene glycol methyl ether, dipropylene glycol dimethyl ether, ethyl lactate, propylene glycol n-propyl ether, propylene glycol phenyl ether, ethylene glycol n-butyl ether, diethylene glycol n-butyl ether, or mixtures thereof; wherein the selected solvents have a vapor pressure (mm Hg@25° C.) ranging from about 0.1 to about 7.0; a vapor density (air=1) ranging from 2.0 to about 6.0; a boiling point ranging from about 100° C. to about 300° C.; a specific heat (j/g/° C.) ranging from about 0.3 to about 2.3; a heat of vaporization (j/g@BP) ranging from about 250.0 to about 270.0; and a surface tension lower than that of water upon dilution with water the composition forms a low viscosity use solution;

b. a surfactant that is an alcohol ethoxylate, an EO/PO block copolymer, a sulfonate, a phosphate ester, an alkanoate, an amine oxide, an alkyl polyglucoside, a dipropionate, or mixtures thereof;

c. a chelating agent;

d. a buffer;

e. a builder;

f. an anti-redeposition agent; and g. water, h. corrosion inhibitor.

* * * * *